US005768863A

United States Patent [19]

McGregor et al.

[11] Patent Number: 5,768,863

[45] Date of Patent: Jun. 23, 1998

[54] GUSSET CONTROL MECHANISM FOR BAG CLOSING MACHINES

[75] Inventors: Harold R. McGregor, Owatonna; James R. McGregor, Lakeville; Scott Mitchell Anderson, Austin; Kurt Bernard Snaza, Owatonna, all of Minn.

[73] Assignee: Slidell, Inc., Owatonna, Minn.

[21] Appl. No.: 822,228

[22] Filed: Mar. 21, 1997

[51] Int. Cl.[6] ..... B65B 43/26; B65B 43/28; B65B 61/00

[52] U.S. Cl. ..... 53/570; 53/384.1; 53/370.2; 141/114

[58] Field of Search ..... 53/459, 468, 469, 53/570, 571, 573, 384.1, 370.2; 141/10, 114

[56] References Cited

U.S. PATENT DOCUMENTS

| | | | |
|---|---|---|---|
| 4,432,186 | 2/1984 | McGregor | 53/573 X |
| 4,563,864 | 1/1986 | Eschmann | 53/571 X |
| 4,840,016 | 6/1989 | Muller, Jr. | 53/573 X |
| 5,119,615 | 6/1992 | Kujubu et al. | 53/573 X |
| 5,337,541 | 8/1994 | Gmuer | 53/459 |
| 5,452,559 | 9/1995 | Lipes | 53/570 X |
| 5,507,132 | 4/1996 | Gwiazdon et al. | 53/459 X |
| 5,535,792 | 7/1996 | McGregor | 53/573 X |

*Primary Examiner*—Horace M. Culver
*Attorney, Agent, or Firm*—Moore & Hansen

[57] ABSTRACT

A bag filling machine of the type having a discharge spout with clamps to hold a bag mouth on the spout is disclosed as incorporating gusset pleat gripping assemblies on opposite sides of the spout. Each of those assemblies has a pair of cooperatively actuable gusset gripping members operable between open and closed positions to selectively and independently grip each of the two gusset pleats on opposite sides of a gusset bag and to pull those pleats apart to fully open positions. This increases the effective, material-receiving area of the bag mouth as it is opened with the opening of the spout to dispense granular material into the bag. A gusset tucker is also utilized on each side of the discharge spout in cooperative juxtaposition to the gusset pleat gripping assemblies. The gusset tuckers are moved inwardly towards each other and towards the bag to engage in the fold between the two gusset pleats on each side of the bag as the bag top is flattened to a closed position after being filled on a spout. This action of the gusset tuckers insures that the gusset pleats will be fully returned to their normal shape with a complete V-fold therebetween, after the bag has been spread open by the gusset gripping members.

13 Claims, 8 Drawing Sheets

GUSSET CONTROL MECHANISM FOR BAG CLOSING MACHINES

BACKGROUND OF THE INVENTION

This invention relates to bag filling machines of the type utilizing a spout having a discharge end from which particulate material is dispensed into a bag vertically suspended on the spout. Such machines conventionally utilize spout bag clamps to releasably secure the mouth of a bag onto the spout for filling. U.S. Pat. No. 4,078,358 discloses bag filling machines of such construction.

As disclosed in U.S. Pat. No. 5,349,996, the discharge spout of such machines may be of a clam shell type utilizing a pair of opposing, pivotal clam-jaw sections movable between closed and open positions for controllably filling a bag clamped on the spout. U.S. Pat. No. 4,432,186 discloses such spout construction on a bag filling machine. That patent also discloses the use of vertically oriented arm assemblies on the opposite sides of the machine filling spout for selective gripping and control of the gussets on the side walls of gusset bags. Such bags present particular problems for continuously and satisfactorily holding the bag mouth on the spout during the filling of a bag, as the spout opens and closes. The aforesaid arm assemblies of U.S. Pat. No. 4,432,186 incorporate gusset clamping fingers which are disposed inside of the bag to sequentially clamp and release the inside of the gusset pleats at predetermined lateral positions as the arm assemblies are moved laterally inwardly and outwardly towards and away from the filling spout. However, the disposition of the gusset clamping fingers inside of the bag and the particular way in which those devices grip and hold the pleats of a bag during filling has not proven to be completely satisfactory. One disadvantage is that the positioning of the gusset clamping and control arm assemblies and fingers inside of a bag interferes with the flow of material into the bag.

Most recently, as disclosed in U.S. Pat. No. 5,349,996 issued to Harold R. McGregor and of common ownership herewith, a pair of clamps have been utilized on each side of the filling spout to externally grip the gussets on each side of a bag during filling. However, as shown in FIG. 5 of the aforesaid '996 patent, the gussets are clamped closed as the bag mouth is opened for filling. This has the undesirable effect of restricting the effective flow area of the bag mouth, and thereby reducing the rate at which bags can be filled.

BRIEF SUMMARY OF THE INVENTION

With the aforesaid background in mind, an improved bag gusset gripping and control apparatus has been developed which advantageously grips the gusset pleats on the opposite sides of a bag and pulls the gussets open, as the spout is opened for filling a bag, with the gripping of the gussets taking place externally of the bag.

The foregoing basic objective has been realized for effective use on gusseted bags made of both paper and plastic, and is particularly characterized by the provision of two pairs of gusset pleat gripping assemblies positioned at each side of the filling spout. Each gripping assembly is comprised of a pair of gusset gripping members positioned so as to be located on the opposite faces of one of the two gusset pleats along one side of a gusset bag, when the bag is vertically hung with its mouth clamped onto the filling spout. The two gusset pleats on each side of a bag are thus separately gripped and controlled to achieve maximum efficiency in bag filling.

To that end, each of the aforesaid gusset pleat gripping assemblies is separately mounted on one of a pair of carriers disposed at each side of the discharge spout. The carriers are preferably in the form of pivotal arms, with each pair of carrier arms being movable towards and away from each other between gusset closing and opening positions. Each gusset pleat gripping assembly is comprised of a pair of gusset gripping members, one of which may be movable relative to the other by power means, such as a pneumatic or hydraulic cylinder, or a servo motor. With this construction and arrangement, the two gusset pleats at each side of a gusseted bag may be each separately gripped by a pair of gusset gripping members, with those pairs of gripping members then being moved away from each other by the actuation of the carrier arms to their separated, open positions. This serves to fully open the gussets on each side of a bag and thus to increase the effective filling area of a bag mouth when it is opened with the discharge spout for filling.

Advantageously, one of the aforesaid gripping members of each gusset pleat gripping assembly comprises a gusset pleat separator which is initially located in the fold space between two gusset pleats along one side of a gusseted bag, as initially vertically positioned on the filling spout. The complimentary gripping member of each of the pleat gripping assemblies is positioned on the opposite side of each gusset pleat. Thus, by preferably actuating that complimentary gripping member from a first, open position to a second, closed position in cooperation with the gusset pleat separator member, a pleat may be gripped between those two members and held for opening and closing of the gusseted side walls of a bag by the opening and closing of the aforesaid carrier arms.

The aforesaid carrier arms for the gusset pleat gripping assemblies are advantageously supported on a mounting frame movable inwardly and outwardly towards and away from the spout in a generally lateral direction. This permits the alternate collapsing and stretching of a bag held on the spout with its gusset pleats gripped between pairs of the gusset gripping members.

As a further beneficial feature, a gusset tucker device is incorporated in the apparatus on each side of the filling spout. That gusset tucker may advantageously take the form of a finger of generally flat shape in a vertical plane, with each tucker finger pointing inwardly towards the spout, and thus towards the fold between gusset pleats on each side of a bag. The gusset tucker fingers are mounted for independent movement inwardly and outwardly towards and away from the spout in a substantially vertical plane. With this arrangement, the tucker fingers may be moved inwardly towards the spout between the two gusset pleats on each side of a bag to engage the fold between the pleats and to force the gussets inwardly. This action of the tucker fingers serves to fully return the pleats to the normal shape they assume when the side walls of a bag are flattened together, after they have been spread open during a bag filling operation.

These and other objects and advantages of the invention will become readily understood as the following description is read in conjunction with the accompanying drawings wherein like reference numerals have been utilized to designate like elements throughout the several views.

DESCRIPTION OF THE PREFERRED EMBODIMENT

Figure 1:
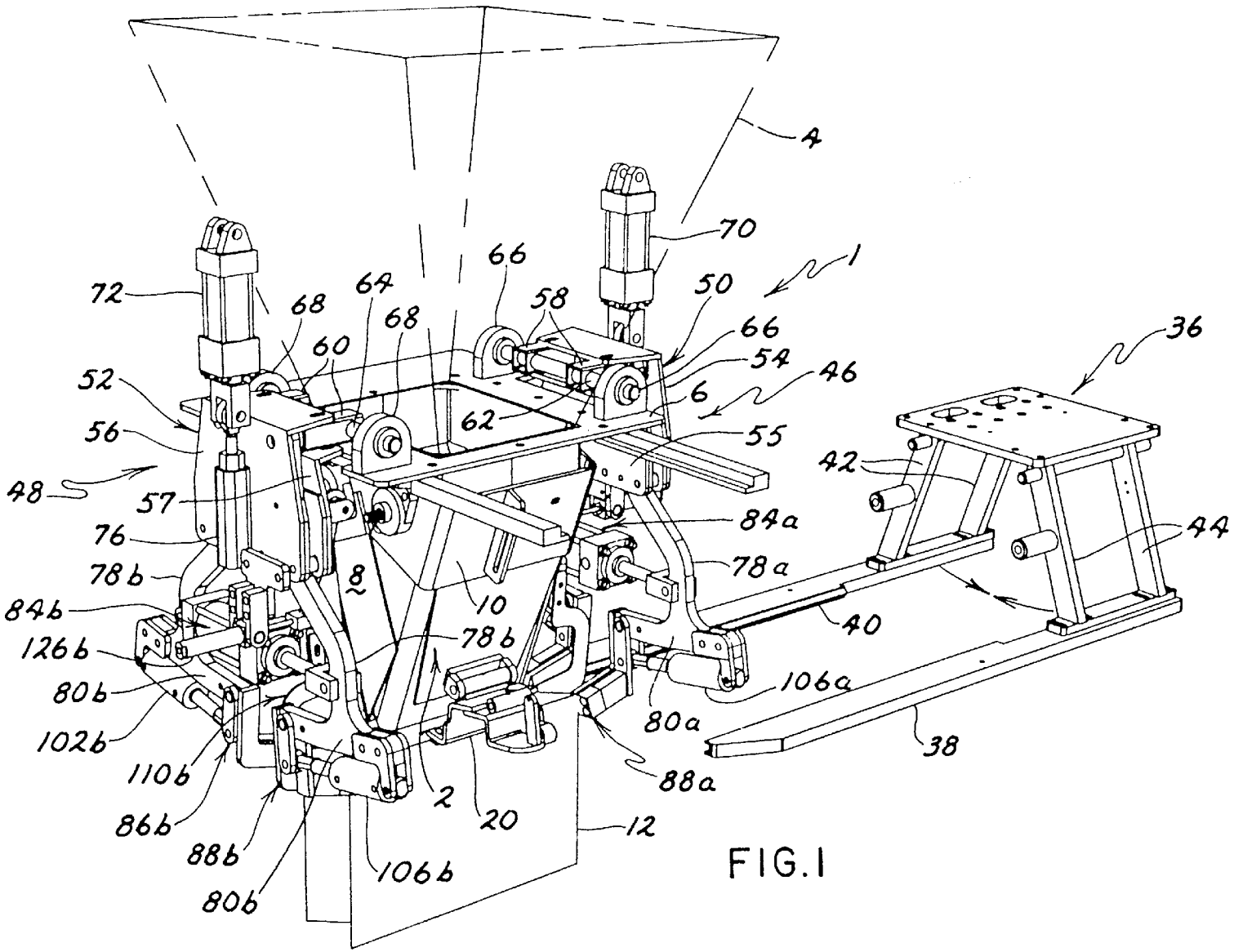
FIG. 1 is a front, perspective view of a bag filling machine incorporating the gusset gripper apparatus of this invention.

FIG. 1 illustrates a bag filling machine incorporating the improved bag gusset gripping and controlling mechanism of this invention. The bag filling machine is of a previously known type as generally described in above-referenced U.S. Pat. Nos. 4,432,186 and 5,349,996. The machine is generally indicated by reference numeral 1, and includes a material discharge spout 2 supported under a supply hopper 4 from a deck 6, and mounted on a frame assembly (not shown). Hopper 4 serves to contain and deliver a supply of particulate material to discharge hopper 2.

Figure 4:
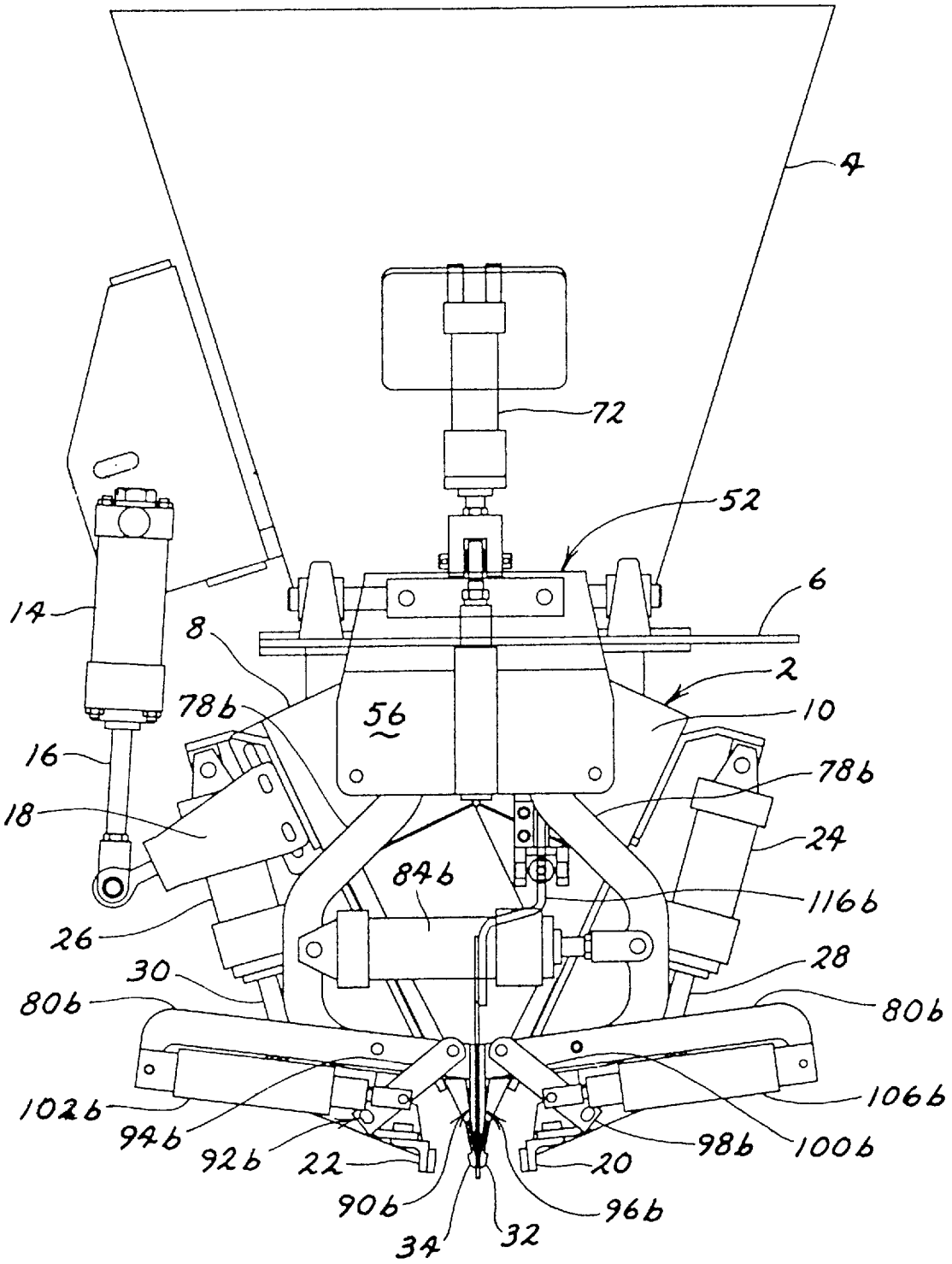
FIG. 4 is an end elevation view of the bag filling machine as viewed from the left end of FIG. 1.

Spout 2 is preferably of the clam shell type, and is comprised of a pair of clam shell halves or jaws 8 and 10 which are pivotable between open and closed positions in a known manner to provide for the controlled discharge of particulate material into a bag 12 clamped on the spout. It is contemplated that a wide range of granular or particulate materials may be effectively dispensed into bags utilizing the improved filling machine as disclosed herein. Such materials would include, for example, cereals, pet food, feeds, and seeds. Power means, preferably in the form of a double acting pneumatic cylinder 14, having a piston 16 as illustrated in FIG. 4, may be utilized to open and close spout clam shell halves 8 and 10 by way of a connecting link plate 18. A connecting rod (not shown) extends between the upper ends of clam shell sections 8 and 10 so that the pivotal movement of one clam shell section by the extension and retraction of piston 16 serves to simultaneously operate the other clam shell section. As disclosed in U.S. Pat. No. 4,432,186, the disclosure of which is incorporated herein by reference, such a connecting rod permits the two clam shell sections to pivot towards and away from each other in opening and closing movement.

Figure 3:
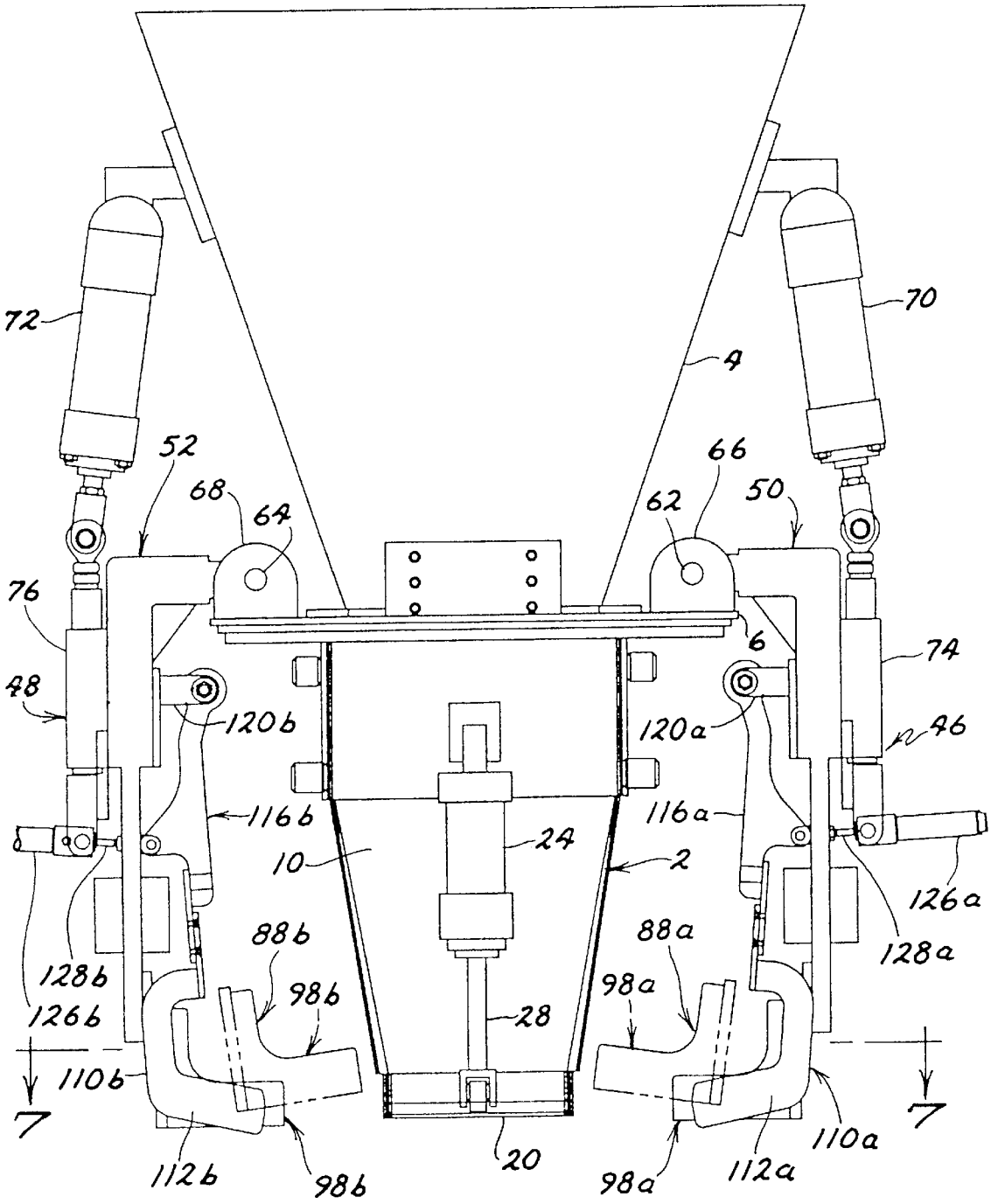
FIG. 3 is a side elevation view of the bag filling machine as viewed from the front side of FIG. 1.

As is also disclosed in the '186 and '996 patents referenced herein, the bag filling machine of the type utilized with the gusset gripper apparatus of this invention also incorporates a pair of bag clamps 20 and 22 on the bottom end of the spout sections 8 and 10 for clamping the opposite side walls, at the top of the bag, against the outside faces of the bottom ends of the spout sections 8 and 10. Such spout bag clamps 20 and 22 are shown in FIGS. 3 and 4, with only clamp 20 being shown in FIG. 1. Bag clamps 20 and 22 are operable by means of double acting power cylinders 24 and 26 having reciprocating pistons 28 and 30 as shown in FIGS. 3 and 4. The extension of pistons 28 and 30 serves to move clamps 20 and 22 inwardly from the open position shown in FIG. 4 to engagement with the outside walls of a bag. The opposed side walls of a bag are thus clamped between clamps 20 and 22 and the bottom, outside face plates 32 and 34 on spout sections 8 and 10. Spout bag clamps 20 and 22 and their power actuators are of the same basic construction and operation as disclosed with respect to comparable spout bag clamps in U.S. Pat. No. 5,349,996, the disclosure of which is also incorporated herein by reference.

As is also shown in FIG. 1, a pair of bag forming bars 38 and 40 mounted on a carriage 36 may be utilized for gripping and flattening a bag after it has been filled on spout 2, and for transporting the filled bag to a closing or sealing station, if desired. Alternatively, the bag may be sealed on the spout. Forming bars 38 and 40 are of the construction and operation as disclosed in U.S. Pat. No. 4,432,186 with respect to forming bars 142 and 144. Such forming bars are pivotally suspended from legs 42, 44 of carriage 36 for swinging movement inwardly and outwardly towards and away from each other as indicated by the directional arrows in FIG. 1. As shown in FIG. 1, the bars 38 and 40 are in their open position. A power cylinder (not shown) may be utilized in the same manner as disclosed in the aforesaid '186 patent to extend between the carriage legs 42, 44 for moving bars 38 and 40 towards each other from the open position shown in FIG. 1, to their closed position in gripping engagement across the outside faces, of the side panels of a bag 12, after it has been filled. Carriage 36 may be translated laterally on guide bars between the bag delivery position shown in FIG. 1 for closing, and a second position adjacent the spout with bars 38 and 40 straddling the bag 12. Carriage 36 is also vertically movable for lowering a filled bag from spout 2. Such a carriage mounting and traversing apparatus is also disclosed in the '186 patent. The operation of forming bars 38 and 40 in conjunction with the gusset gripping and control apparatus of this invention is hereinafter set forth with respect to the description of the operational sequence of FIG. 7.

The bag gusset gripping and control apparatus of this invention may be understood most clearly by reference to FIGS. 1 through 4. As disclosed therein, gusset clamping units 46 and 48 are provided on each side of spout 2. Each such gusset clamping unit incorporates a mounting frame 50, 52 comprised of a pair of right angle support plates 54, 55 and 56, 57, respectively. Those plates are bolted or otherwise secured to horizontally extending pivot arms 58 and 60 attached to shafts 62, 64 rotatably supported in pairs of bearing blocks 66 and 68, respectively. Each of the gusset clamping units 46, 48 may thus pivot on the axes defined by shafts 62 and 64.

Power means, preferably in the form of doubt acting, pneumatic cylinders 70 and 72 are pivotally attached to opposite side walls of the hopper 4 as illustrated in FIG. 3. Those cylinders may advantageously be attached through clevis connectors shown at their bottom ends to mounting and adjusting blocks 74 and 76 on each side of the spout 2. Those mounting blocks are secured to outside plates 54 and 56 of the mounting frames 50 and 52. Thus, by extending and retracting the pistons of cylinders 70 and 72, the mounting frames 50 and 52 may be swung inwardly and outwardly towards and away from the side walls of spout 2, for a purpose hereinafter set forth.

Carriers in the form of gusset opening and bag stretching arms **78*a* and 78*b* are pivotally mounted on opposite sides of spout 2 for independent, swinging movement in the vertical planes of the mounting frame plates 54, 55 and 56, 57. For that purpose, the upper ends of arms 78*a* and 78*b* extend between the pairs of mounting plates, 54, 55 and 56, 57, respectively, and are pivotally secured thereto on horizontal axes defined by pivot pins not shown. Those pivot pins extend through apertures in the upper ends of carrier arms 78***a* and 78*b*, one set of said apertures 82 being shown on arms 78*a* in FIG. 2. Extending between each pair of arms 78*a* and 78*b* are double acting, power cylinders 84*a* and 84*b*. As may be readily understood, the extension and retraction of the pistons associated with those cylinders serves to move the respective pairs of arms 78*a* and 78*b* towards and away from each other. As is hereinafter set forth, that movement of the carrier arms towards and away from each other in a vertical plane permits gusset gripping assemblies carried on each of those arms to selectively open and close the gusset pleats on a bag being filled.

Each of the carrier arms 78*a* and 78*b* supports at its lower end a generally horizontally extending segment 80*a* and 80*b*, respectively. Mounted on those horizontal segments 80*a* and 80*b* are gusset pleat gripping assemblies 86*a*, 88*a* and 86*b*, 88*b*, on each side of spout 2. It is to be noted that since each of the gusset gripper assemblies on opposite sides of the spout are identical, including their carrier arms, the same reference numerals have been given to such components, with the suffix letters "a" and "b" serving to identify the elements of those assemblies on the right and left sides of the machine, respectively, as viewed in FIGS. 1 and 3.

Figure 2:
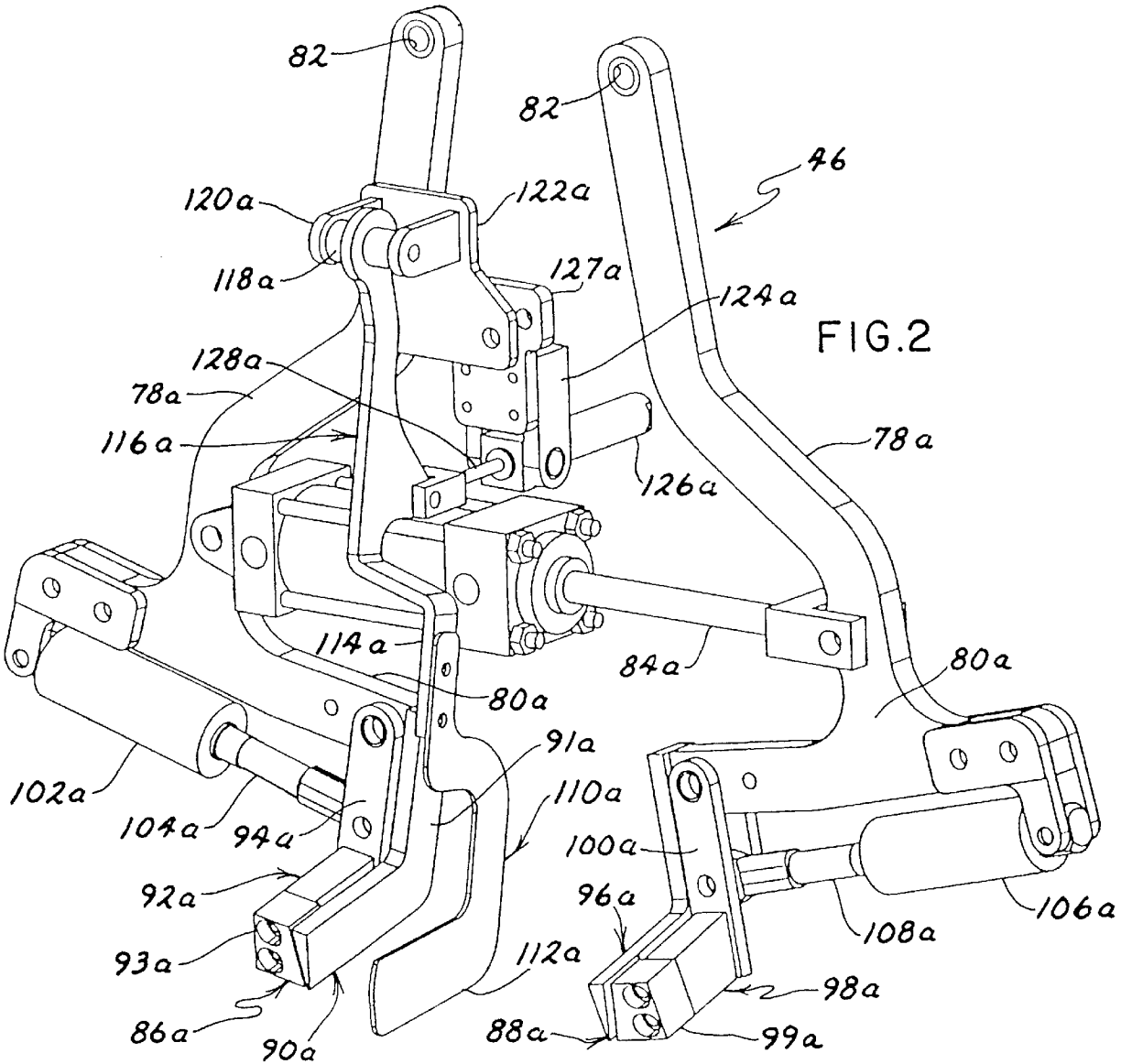
FIG. 2 is a fragmentary, perspective view showing one set of the gusset pleat gripping assemblies at one end of the machine of FIG. 1.

Referring primarily to the gusset gripping assembly as illustrated in FIG. 2, it will be seen that each gusset pleat gripping assembly on one side of the spout is comprised of a pair of gusset gripping members 90*a*, 92*a* and 96*a*, 98*a*, respectively. Preferably, the gripping members 90*a* and 96*a* are of right angle shape as shown and include vertically extending segments 91*a* and 97*a*, respectively. Those latter segments are secured to the innermost ends of carrier arm segments 80*a*, as by welding or by the use of fasteners. The complimentary and cooperating gripping members 92*a* and 98*a* have knurled heads 93*a* and 99*a* on their outer ends, which directly cooperate with members 90*a* and 96*a* in gripping the pleats of a gusseted bag therebetween. Each of the gripping members 92*a* and 98*a* are mounted on upright links 94*a* and 100*a*, respectively, with those links being pivotally attached at their upper ends to carrier arm segments 80*a*. Double acting power cylinders 102*a* and 106*a* mounted as shown on the underside of carrier arm segments 80*a* have their pistons 104*a* and 108*a*, respectively, attached to upright link segments 94*a* and 100*a*. Thus, by extending and retracting pistons 104*a* and 108*a* of cylinders 102*a* and 106*a*, pivotal gripper members 92*a* and 98*a* may be moved inwardly and outwardly towards and away from cooperating gripper members 90*a* and 96*a*.

As is hereinafter described, the innermost gripper members 90*a* and 96*a* are preferably wedge shaped as shown to facilitate their being received in the centerfold between the two gusset pleats along each side of a gusseted bag. Those gripping members 90*a* and 96*a* are thus supported on carrier arms 78*a* so as to be located where they will be positioned in the aforesaid manner in the fold between the two gusset plates along one side of a gusseted bag to function as a pleat separator when a bag 12 is hung on the bottom end of spout 2 for filling, in the manner shown in FIGS. 1 and 7B.

In order to insure that the gusset pleats of a gusseted bag will return to their normal, collapsed position with a complete V-fold therebetween, after filling and after the release of the bag by the gusset clamps, a gusset tucking device has been incorporated in the gusset gripping and control apparatus. The tucker devices are generally indicated by reference numerals 110*a* and 110*b*, which are located on each side of the spout as illustrated in FIGS. 1-4. Here again, the construction, mounting, and operation of the tucker devices on each side of the spout are identical, and thus only one of such devices has been described, primarily with respect to the "a" suffix numbers. The corresponding tucker device components and its mounting arrangement have been designated, as shown in FIG. 1, by the reference number suffix "b."

The tucker devices 110*a* and 110*b* are advantageously located as shown between the innermost gripping members 90*a*, 96*a* and 90*b*, 96*b*, respectively. Those tucker devices preferably are of elongated, flat shape and are disposed in a generally vertical plane as shown. Tucker device 110*a* terminates at its lower end in a generally horizontally extending finger portion 112*a* for engagement within the fold between the two pleats on one side of a bag as illustrated in FIG. 7E.

As shown most clearly in FIG. 2, the gusset tucker 110*a* is connected at its upper end to downwardly depending member 114*a* of a pivotal hanger arm 116*a*. The apertured top end of hanger arm 116*a* is supported on a pivot pin 118*a*. A clevis 120*a* holds pivot pin 118*a* and is attached to a mounting plate 122*a*, secured as by fasteners through fastening holes shown to support plate 55 of mounting frame 50.

Gusset tucker 110*a* is independently movable inwardly and outwardly with respect to spout 2 in a substantially vertical plane by means of a double acting power cylinder 126*a* having a piston 128*a*. As shown in FIGS. 2 and 3, piston 128*a* is connected by a clevis to a projection on hanger arm 116*a*. Cylinder 126*a* is suspended from a clevis 124*a* attached to a separate mounting plate 127*a* secured to outer support plate 54 (FIG. 1) of mounting frame 50.

The various power actuating devices for the moving elements have been described herein as preferably being double acting, pneumatic cylinders. However, it is to be understood that any type of a power motor could be utilized for such purposes, including pneumatic, hydraulic, or electric motors.

The operation of the gusset gripping apparatus in a predetermined sequence of steps is illustrated in FIGS. 7a–7h. Those views are partially schematic, top plan views taken along lines 7—7 of FIG. 3 so as to show the primary operating components of the bag clamping and gusset gripping apparatus in the sequential stages of operation. In the views of FIG. 7, the gusseted bag 12 is showing as having a pair of gusset pleats P-1, P-2 along one side wall, and a second pair of gusset pleats P-3 and P-4 along its opposite side wall.

Figure 7A:
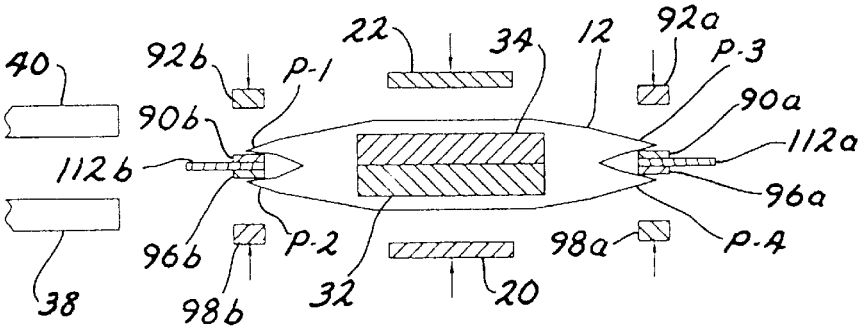
FIGS. 7A–7H are top, plan views taken along lines 7—7 of FIG. 3 and showing the gusset grippers and spout bag clamps in successive positions assumed as the bag filling machine goes through a complete bag filling operation with a bag on the spout.

At the start of a bag filling operation, the spout bag clamps 20, 22 are open, and the gusset gripper assemblies 86*a*, 88*a* and 86*b*, 88*b* are in the positions shown in FIG. 4, and as schematically illustrated in FIG. 7A. At that time, carrier arms 78*a* and 78*b* are pulled together, with the pistons of their actuating cylinders 84*a* and 84*b* retracted. Gusset gripper members 92*a*, 98*a* and 92*b*, 98*b* will also be in their open or retracted positions. Cooperating gusset gripping members in the form of gusset pleat separators 90*a*, 96*a* and 90*b*, 96*b* are positioned as shown in FIGS.4 and 7A so as to be received between the opposite pairs of gussets P-1, P-2 and P-3, P-4 of a bag 12 positioned as shown in FIG. 1 and FIG. 7A around the bottom ends 32 and 34 of discharge spout 2.

The opposed side walls of bag 12 are positioned between spout bottom walls 32, 34 and spout bag clamps 20 and 22. With the pistons of cylinders 70 and 72 retracted, the opposed gusset gripping units 46 and 48 on opposite sides of spout 2 will be swung outwardly so as to position the gusset pleat separator members 90*a* 96*a* and 90*b*, 96*b* as shown in FIG. 7A between the respective pairs of gusset pleats P-3, P-4 and P-1, P-2. At this time, the fingers 112*a* and 112*b* of the gusset tuckers 110*a* and 110*b* will be in their outwardly moved positions away from the opposite sides of spout 2 with pistons 128*a* and 128*b* of cylinders 126*a* and 126*b* retracted. In their normal, bag receiving positions as shown in FIG. 7*a*, the gusset pleat separator members 90*a*, 96*a* and 90*b*, 96*b* are spaced apart sufficiently that tucker fingers 112*a* and 112*b* may be received and positioned therebetween.

Figure 5:
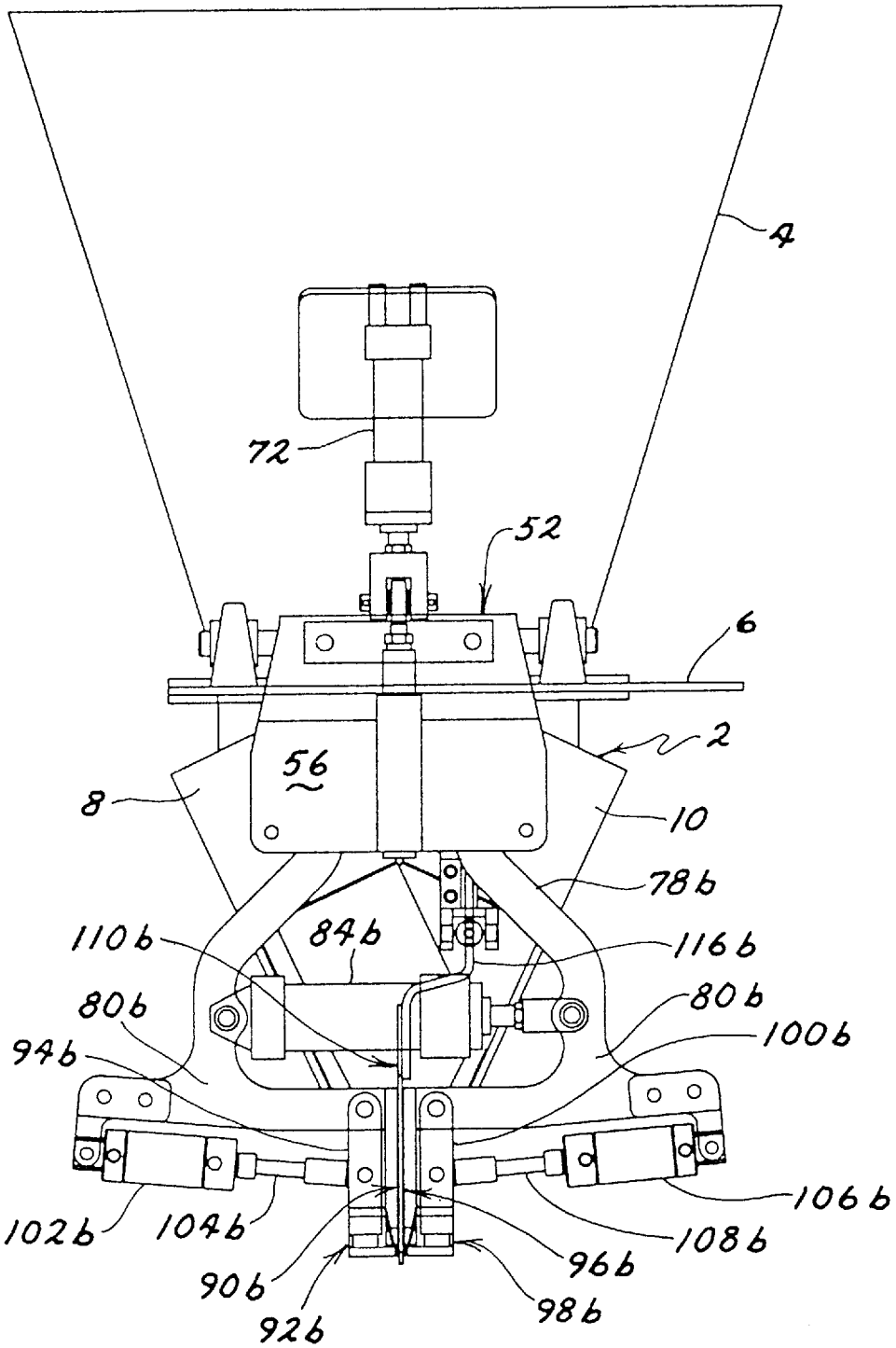
FIG. 5 is an end elevation view taken at the same location as FIG. 4 and showing the gusset grippers closed as initially engaging a bag clamped on the spout.
Figure 7B:
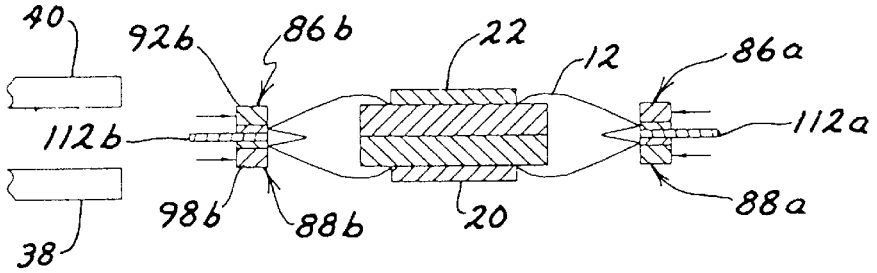

Next, the top end of bag 12 is clamped in place on the bottom end of spout 2 between the spout lower ends 32 and 34 and clamps 20 and 22 by actuating clamps 20 and 22 inwardly to the bag gripping position shown in FIG. 7B. This is done by extending the pistons 28 and 30 of bag clamp actuating cylinders 24 and 26 from the retracted positions shown in FIG. 4. Simultaneously, all four bag gussets P-1, P-2, P-3 and P-4 are clamped between the respective pairs of gusset gripping members 90*a*–92*a*, 96*a*–98*a*, 90*b*–92*b*, and 96*b*–98*b* in the manner shown in FIG. 7B. The gusset clamping action is accomplished by extending the pistons of cylinders 102*a*, 106*a* and 102*b*, 106*b* from the retracted positions shown in FIG. 4. This closed, clamping position of the gusset gripping assemblies 90*a* 92*a* and 96*a*, 98*a* is shown in FIGS. 5 and 7*b*.

Figure 7C:
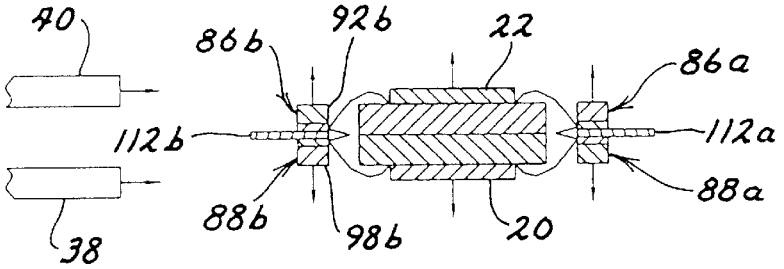

As the next step, the gusset clamping units 46 and 48 are moved laterally inwardly towards the opposite sides of spout 2 in a swinging movement about the pivot axes defined by shafts 62 and 64 by extending the pistons of actuating cylinders 70 and 72. This positions the gusset gripping assemblies 86*a*, 88*a* and 86*b*, 88*b* adjacent the spout as shown in FIG. 7C, and has the effect of collapsing the side walls of bag 12 inwardly. FIG. 3 shows the inwardly moved position of the gusset gripper assemblies 88*a* and 88*b* in phantom line; and those assemblies are shown in solid lines in their initial, outwardly swung positions of FIGS. 7A and 7B.

Figure 6:
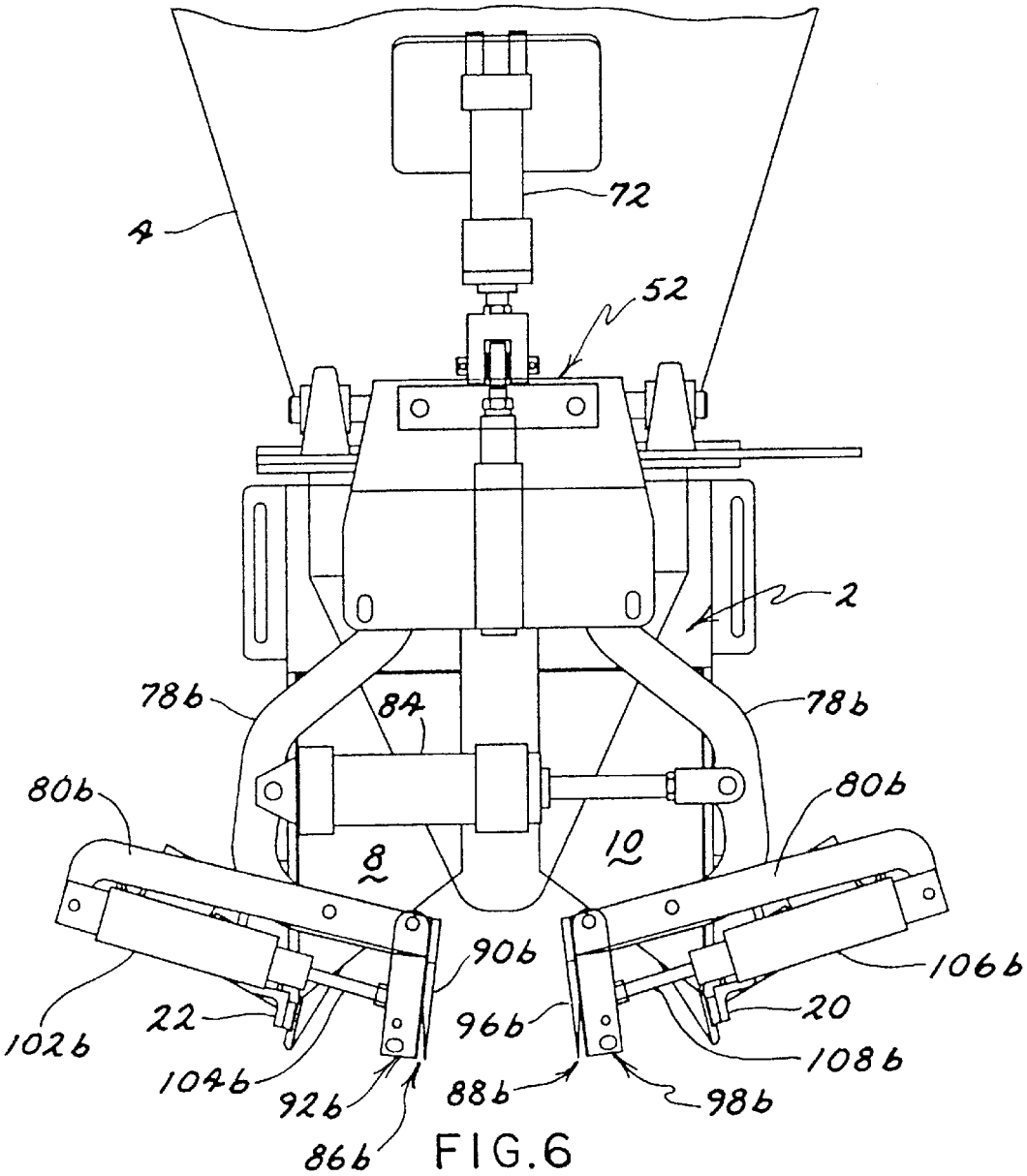
FIG. 6 is an end elevation view taken at the same location as FIG. 4, but showing the spout and gusset gripper assemblies extended open.
Figure 7D:
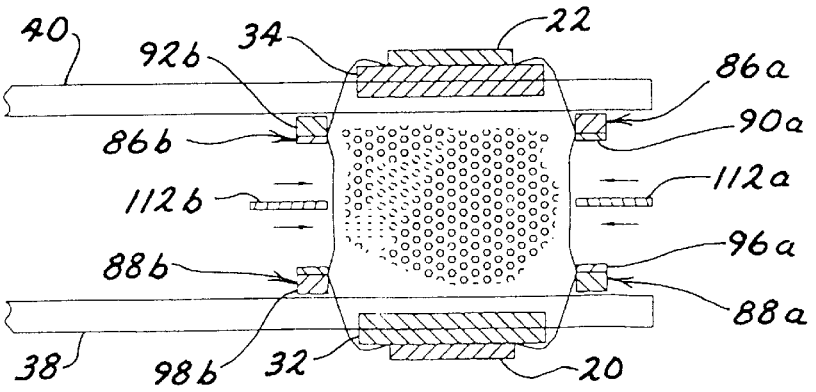
Figure 7E:
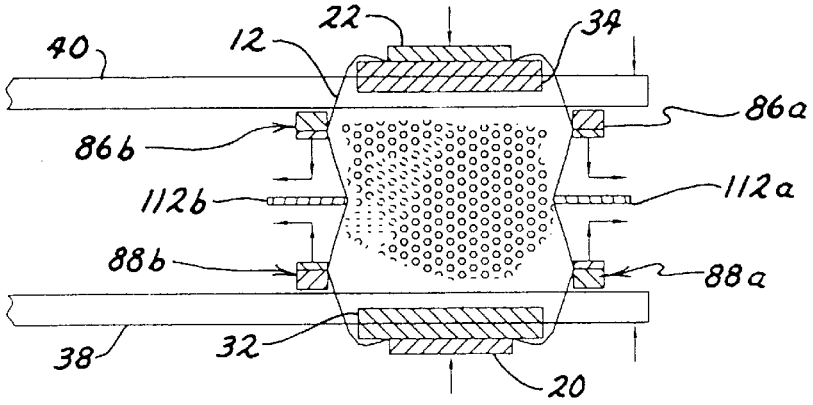

Before the completion of the foregoing step of moving the gusset gripping units 46 and 48 inwardly to the spout, the next step of opening the spout clam shell sections or halves 8 and 10 begins. The opening of the spout clam shell sections, and the separation of the spout bottom ends 32 and 34, is accomplished by retracting piston 16 of spout opening cylinder 14 shown in FIG. 4. FIGS. 6 and 7D show the position of the operating components at the conclusion of this next step, with the spout open and the mouth of bag 12 pulled fully open. Simultaneously with the opening of the spout by the actuation of cylinder 14, cylinders 84*b* and 84*a* are actuated to extend their pistons. This serves to separate carrier arms 78*a* and 80*a* to the positions shown in FIG. 6, simultaneously with the opening of the spout. The separating or moving apart of carrier arms 78*a* and 78*b*, with the gussets P-1 and P-2 and P-3 and P-4 clamped between the members of the clamping assemblies 86*a*, 88*a* and 86*b*, 88*b* serves to pull the gussets apart and open the gusseted side walls fully as illustrated in FIG. 7D. By this mechanical action, the bag mouth is opened to a particularly full extent to present an increased bag receiving area as viewed in FIG. 7D. As a result, the rate at which granular material is dispensed from the bottom end of spout 2 into the bag is significantly increased. Depending upon the bag overall size, and the width between the gussets P-1, P-2 and P-3, P-4 on each side of the bag, the bag mouth receiving area, and thus the flow rate into the bag, may be increased anywhere from 20 percent to 100 percent.

It is to be noted that the bag gusset pleats P-1, P-2 and P-3, P-4 are gripped at their outer points between the gusset gripping members 92*a*, 98*a* and 92*b*, 98*b* on the one hand, and the cooperating, knurled ends 93*a*, 99*a* and 93*b*, 99*b* on gusset gripping members 92*a*, 98*a* and 92*b*, 98*b*. The gusset pleats are so gripped when the gusset pleats and the bag are extended to the fully open position shown in FIG. 7D. At that time, the gusset tuckers 110*a* and 10*b* will still be in the position which they originally assumed at the beginning of the bag filling cycle as shown in FIG. 7A.

After a bag 12 has been filled, the cycle reverses itself. As the first step in the bag closing cycle, the pistons of spout bag clamp cylinders 28 and 30 are extended to close the bottom ends of the spout 32, 34 to the position shown in FIG. 4. The beginning of that spout closing action is shown in FIG. 7E. Simultaneously, the pistons of cylinders 84*a* and 84*b* are retracted so as to move carrier arms 78*a* and 78*b* inwardly towards each other in their bag closing motion. This starts to move the gusset gripping assemblies 86*a*, 88*a* and 86*b*, 88*b* inwardly towards each other as also indicated by the directional arrows in FIG. 7E. Simultaneously with the aforesaid inward movement of the spout bag clamps and the bag gripping assemblies, pistons 128*a* and 128*b* of cylinders 126*a* and 126*b* are extended to swing the gusset tuckers 110a and 110*b* inwardly about their pivot pins 118*a* and 118*b* to the positions shown in FIG. 3. This inward movement of the gusset tucker fingers 112*a* and 112*b* towards the spout 2 is also shown in FIG. 7E, with those tucker fingers engaging the fold between the two pairs of gusset pleats on each of the bag side walls so as to push that fold inwardly from the opposite sides of the bag towards the bag. This action of the gusset tucker fingers serves to insure that the gusset pleats P-1, P-2 and P-3, P-4 are returned to their fully collapsed positions shown in FIG. 7A, and so as to form a full "V" fold between the respective pairs of gusset pleats. On some types of bags, particularly plastic bags, there could be a tendency of the gusset pleats not to return fully inwardly to their normally closed positions, when the bag is flattened and closed by the closing of the spout side walls 32, 34 at the bottom of the spout 2.

Figure 7F:
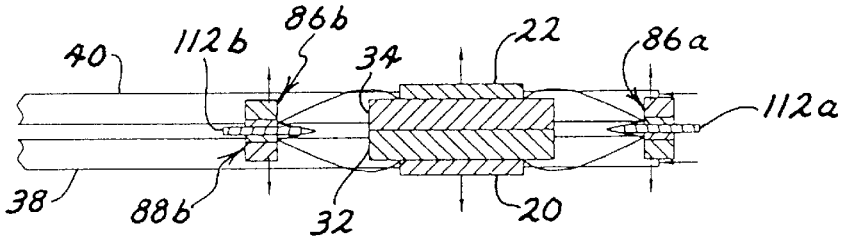
Figure 7G:
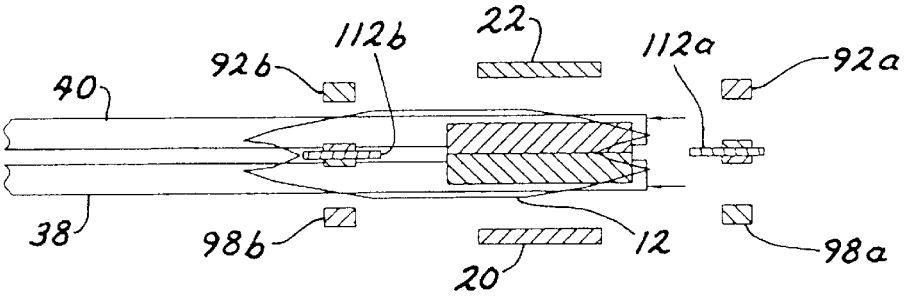

FIG. 7F shows the spout fully closed and the gusset gripping assemblies moved back inwardly to their gusset closing positions by the inwardly swinging action of carrier arms 78*a* and 78*b*. Cylinders 70 and 72 are then again actuated to their retracted positions to swing the gusset clamping units 46 and 48 back outwardly, away from spout 2, to the positions shown in solid lines with respect to gusset gripping assemblies 88*a* and 88*b* in FIG. 3. This has the effect of stretching or pulling the side walls of bag 12 tight as shown in FIG. 7F.

Figure 7H:
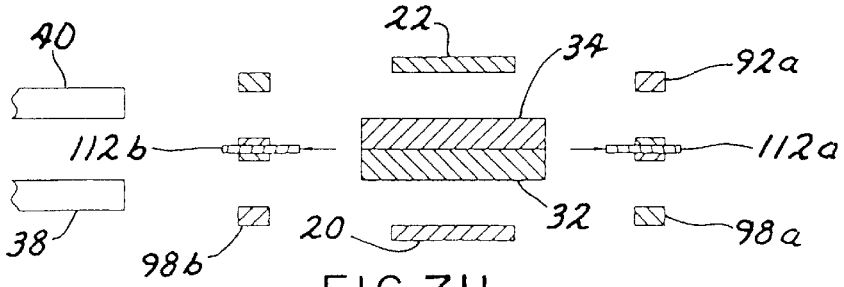

Simultaneously with the foregoing steps, the bag forming and delivery bars 38 and 40 are properly positioned. Initially, those bars are in their retracted positions away from the bag spout as shown in the steps 7A, 7B and 7C with the forming bars swung inwardly together. Commencing with the step illustrated in FIG. 7D, the forming bars are spread apart or opened and moved towards the spout to embrace the bag, below the spout. At the time that the bag gripping components are moved to the positions shown in FIG. 7F, the forming bars are swung inwardly towards each other by a power cylinder (not shown) supported between the carrier legs 42 and 44. The forming bars 38 and 40 are shown in that inwardly moved position in FIG. 7F, in flattening engagement against the bag side walls, below the bottom end of spout 2. At this point, the bag is thus gripped and firmly held by the bars 38 and 40. Thereafter, the step of FIG. 7G may be carried out, with the spout clamps 20 and 22 being swung to their open, bag release positions by the retraction of the pistons 28 and 30 of clamp actuating cylinders 24 and 26, as shown in FIG. 4. Simultaneously, cylinders 102*a*, 106*a* and 102*b*, 106*b* are actuated to retract their pistons and open the gusset gripping assemblies by the movement of gusset member 92*a*, 98*a* and 92*b*, 98*b* away from their complimentary and cooperating gusset members 90*a*, 96*a* and 90*b*, 96*b*. Those components are shown in their opened positions in FIG. 7G. The bag has now been fully released from the spout clamps and gusset clamps and is held by the forming bars 38 and 40. Those bars are then moved on a slide carriage of the type referenced above to deliver the bag, if desired, to a bag closing station. FIG. 7H illustrates the forming bars 38 and 40 having moved to that bag delivery position, and with the spout clamps and gusset clamps in their fully opened positions. That positioning of the various bag handling components is now the same as illustrated in FIG. 7A, with the machine being ready to receive another bag for filling. After the filled bag has been removed from the spout, the gusset tucker fingers 112*a* and 112*b* are moved from the position shown in FIG. 7H, outwardly as indicated by the directional arrows in that figure, to their bagreceiving positions shown in FIG. 7A.

Figure 8:
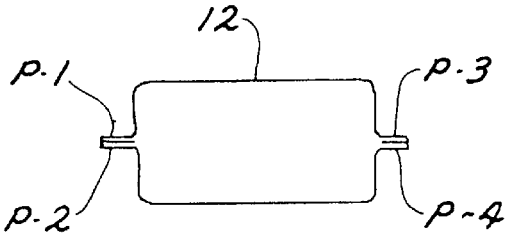
FIG. 8 is a top plan view of a prior art embodiment of an open, gusseted bag as being filled on a spout.
Figure 9:
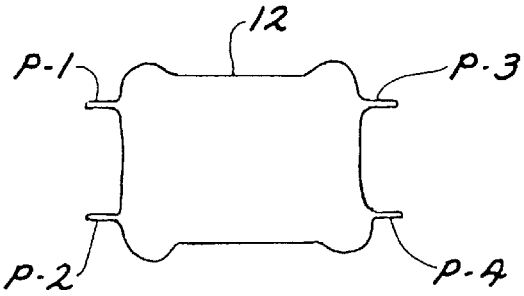
FIG. 9 is a top plan view of a gusseted bag as fully opened for filling with the gusset grippers of this invention.

FIGS. 8 and 9 graphically illustrate in schematic form the increased bag mouth filling area accomplished by the gusset gripping apparatus of this invention. FIG. 8 shows a prior art embodiment in which the bag gusset pleats are gripped together and held closed when the bag mouth is opened for filling on a spout. FIG. 9 shows the position which the bag mouth and its gussets P-1, P-2 and P-3, P-4 will assume when fully opened to a materialreceiving position by the gusset gripping assemblies disclosed herein. It will be seen that the receiving area of the bag 12 is significantly increased by separately gripping each pair of gusset pleats P-1, P-2 and P-3, P-4 and pulling those pleats open, in a direction away from each other as is accomplished by the operation illustrated in FIG. 7D.

It is anticipated that various changes may be made in the size, shape, and operating mechanisms of the bag filling machine, with its gusset pleat gripping assemblies, as disclosed herein, without departing from the scope and spirit of the invention as defined by the following claims.

What is claimed is:

1. In a bag filling machine having a discharge spout actuatable between closed and open positions for the discharge of particulate material into a bag, and clamping means for holding the mouth of a bag on the spout, the improvement comprising:

a pair of gusset pleat separator members positioned on each side of the spout and constructed and arranged to be located in the fold space between the two gusset pleats along each side of a gusseted bag vertically positioned with its mouth on the spout;

a pair of gusset gripping members positioned on each side of the spout in opposed, cooperative gripping disposition, to each of the gusset pleat separator members and movable from first, open positions to second, closed positions in cooperation with said gusset pleat separator members to grip each of the four gusset pleats of a gusseted bag therebetween;

power means for moving said gripping members between said first and second positions;

a pair of separable arms on each side of the spout, with each of the arms carrying a gusset pleat separator and a gusset gripping member combination, and each pair of arms being movable towards and away from each other between first, gusset closing positions and second, gusset opening positions wherein the gussets on each side of a bag are stretched open to increase the area of a bag mouth during filling.

2. The improvement in a bag filling machine of claim 1 wherein:

each pair of separable arms on each side of the spout is mounted on a carrier movable inwardly and outwardly towards and away from the spout in a generally lateral direction to alternately collapse and stretch a bag held on the spout with its gusset pleats gripped between said pairs of pleat separator members and said gusset gripping members.

3. The improvement in a bag filling machine of claim 2 wherein:

each of said carriers is pivotally mounted for swinging movement in a generally lateral direction; and power means connected to each of said carriers and actuable to swing said carriers inwardly and outwardly towards and away from the spout.

4. The improvement in a bag filling machine of claim 1 wherein:

said power actuators are mounted on said arms for movement therewith.

5. The improvement in a bag filling machine of claim 1, and further including:

a gusset tucker member supported on each side of the spout for independent movement inwardly and outwardly towards and away from the spout in a substantially vertical plane, said tucker members being constructed and arranged to move inwardly towards the spout between the two gusset pleats on each side of a bag to engage the fold between the pleats and to assist in fully returning the gusset pleats to the shape they normally assume when the side walls of a bag are flattened together after a filling operation.

6. The improvement in a bag filling machine of claim 5 wherein:

each of said tucker members is of elongated, flat shape in a generally vertical plane and includes a finger portion projecting inwardly towards the spout on each side of the machine.

7. The improvement in a bag filling machine of claim 6 wherein:

the finger portion of each tucker member is positioned between the pair of gusset pleat separator members on each side of the spout.

8. In a bag filling machine having a discharge spout actuable between closed and open positions for the discharge of particulate material into a bag, and clamping means for holding the mouth of a bag on the spout, the improvement comprising:

two pairs of oppositely disposed, gusset pleat gripping assemblies at each side of the spout, with each gripping assembly being comprised of a pair of gusset gripping members constructed and arranged to be located on opposite faces of a single one of the two gusset pleats along one side of a gusseted bag;

means for moving each pair of gusset gripping members relative to each other between first, open positions, and second, closed positions in gripping engagement with a gusset pleat; and a pair of gusset assembly carriers at each end of the spout, with each carrier separately supporting one pair of gusset gripping members, and each pair of carriers being movable relative to each other between gusset closing and opening positions, whereby the two gusset pleats at each side of a gusseted bag may be pulled apart when gripped by the gusset gripping members to open the bag gussets and thereby increase the effective filling area of a bag mouth held on the spout by said clamping means, by moving each pair of carriers to said gusset opening positions when the discharge spout is actuated to its open position.

9. The improvement in a bag filling machine of claim 8 wherein:

said gusset assembly carriers are supported for movement inwardly and outwardly towards and away from the spout.

10. The improvement in a bag filling machine of claim 8, and further including:

a gusset tucker member supported on each side of the spout for independent movement inwardly and outwardly towards and away from the spout in a direction substantially normal to the direction of movement of the gusset assembly carriers, said tucker members being constructed and arranged to be moved towards each other between the two gusset pleats on each side of a bag clamped on the spout to engage the fold between the pleats.

11. The improvement in a bag filling machine of claim 10 wherein:

each of said tucker members includes a finger portion projecting substantially horizontally for reception between the two gusset pleats on each side of a bag clamped on the spout.

12. The improvement in a bag filling machine of claim 11 wherein:

each of said tucker member finger portions are of substantially flat, elongated shape.

13. The improvement in a bag filling machine of claim 10, and further including:

a pair of substantially parallel, spaced apart forming bars movable towards and away from each other between bag gripping and release positions, said forming bars being supported on a carriage movable to position the forming bars under the spout to embrace and flatten the top of a bag after it is filled on the spout.

* * * * *